United States Patent [19]

Kreick et al.

[11] 4,241,292

[45] Dec. 23, 1980

[54] RESISTIVE HEATER

[75] Inventors: John R. Kreick; Glenn A. Anderson, Sr., both of Nashua, N.H.

[73] Assignee: Sanders Associates, Inc., Nashua, N.H.

[21] Appl. No.: 953,244

[22] Filed: Oct. 20, 1978

[51] Int. Cl.[3] ..... H05B 3/08

[52] U.S. Cl. ..... 219/541; 13/25; 219/354; 219/553; 338/316; 338/322

[58] Field of Search ..... 219/345, 354, 411, 528, 219/541, 544, 552, 553; 338/315, 316, 330, 322; 13/20, 25, 31; 264/105

[56] References Cited

U.S. PATENT DOCUMENTS

| | | | |
|---|---|---|---|
| 994,447 | 6/1911 | Egly | 338/316 X |
| 1,593,725 | 7/1926 | Sharpe | 338/316 X |
| 2,735,881 | 2/1956 | Mann | 13/25 |
| 2,768,277 | 10/1956 | Buck et al. | 13/25 X |
| 3,139,474 | 6/1964 | Weech | 13/31 |
| 3,155,759 | 11/1964 | Marshall | 13/25 |
| 3,307,136 | 2/1967 | Fitzer et al. | 338/322 |
| 3,321,727 | 5/1967 | Schrewelius | 338/330 |
| 3,538,231 | 11/1970 | Newkirk et al. | 13/25 |
| 3,875,477 | 4/1975 | Fredriksson et al. | 13/25 X |
| 3,969,943 | 6/1976 | Andersen | 13/25 X |

FOREIGN PATENT DOCUMENTS

| | | | |
|---|---|---|---|
| 49653 | 2/1939 | France | 338/316 |
| 61614 | 10/1939 | Norway | 338/316 |
| 62892 | 9/1940 | Norway | 338/316 |

*Primary Examiner*—Volodymyr Y. Mayewsky
*Attorney, Agent, or Firm*—Louis Etlinger; Richard I. Seligman

[57] ABSTRACT

A resistive heater comprising an emitter, including a hot zone center section and lower temperature end sections, disposed within a protective tube with the emitter and protective tube being mounted within end caps with a spring mechanism provided to allow for the difference in expansion and contraction of the emitter and protective tube during heating and cooling.

3 Claims, 2 Drawing Figures

RESISTIVE HEATER

The Government has rights in this invention pursuant to contract No. DAAB07-75-C-1983 awarded by the Department of the Army.

BACKGROUND OF THE INVENTION

There are many requirements for high efficiency, low contact loss, compact resistive heaters, such as, sources of infrared radiation, various heating applications, and ignitors for gas appliances, such as, stoves and driers. Such resistive heaters are basically a section of uniform resistance material having connection means at the ends thereof for applying electrical power. These heaters are problemsome from many points of view.

At high heater operating temperatures the heater ends become too hot to make stable electrical connections thereto. Also, in certain applications where there is a large amount of moving air near the emitter much of the heat is drawn away from the heating elements by convection. In the past the heating elements have been put in protective tubes to protect against such convection heat loss. However, because of the difference in expansion and contraction of the materials making up the heating element and the protective tube, it has been somewhat difficult to mechanically couple the two for providing a compact unit.

SUMMARY OF THE INVENTION

Accordingly, it is an object of this invention to provide an improved resistive heater.

It is another object of this invention to provide an improved resistive heater including an emitter having low temperature end sections for ease of connection.

It is a further object of this invention to provide a resistive heater having a protective housing and means for compensating for the difference in expansion and contraction of the emitter and protective housing during heating and cooling.

Briefly, a high efficiency, low contact loss, compact resistive heater is provided by employing a three-piece emitter comprising a center hot zone preferably made of silicon carbide, and lower temperature end sections also made of silicon carbide but having a lower resistivity than the center hot section in order to decrease their resistance and thus the temperature thereof. The cross-sectional area of the end sections are also made larger than that of the center hot zone to further reduce the temperature thereof. The end sections are coated with a good electrical conductor to permit good electrical contact thereto.

To prevent convection heat loss the emitter is mounted within a protective tube and the emitter and protective tube are mounted within end caps. The emitter is fixed to the end caps by a means such as a set screw and the protective tube mounted within the end caps against deflectable washers so as to allow for the difference in expansion and contraction of the emitter and protective tube.

BRIEF DESCRIPTION OF THE DRAWINGS

The above-mentioned and other features and objects of this invention will become more apparent by reference to the following description taken in conjunction with the accompanying drawings, in which.

DESCRIPTION OF A PREFERRED EMBODIMENT

Figure 1:
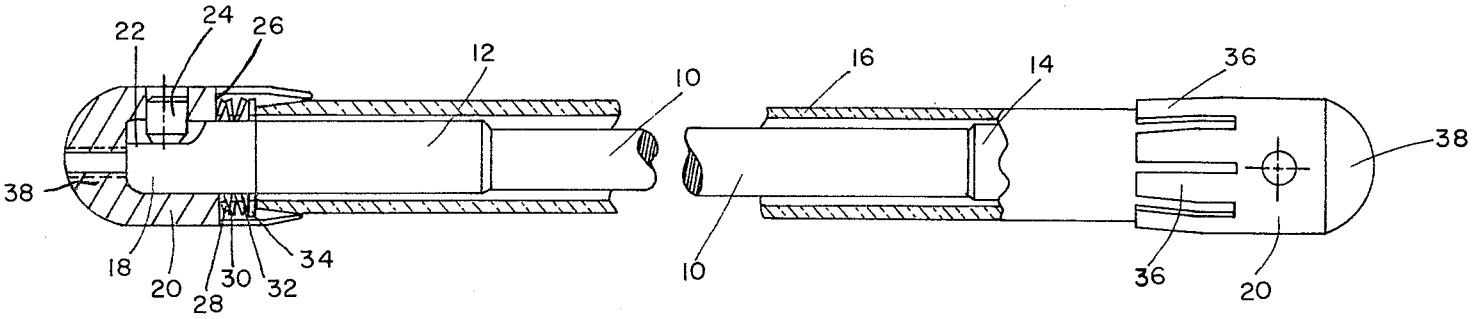
FIG. 1 is a cross-sectional drawing illustrating the resistive heater.

Referring now to FIG. 1 of the drawings, there is illustrated thereby a preferred embodiment of a resistive heater. An emitter comprises a high temperature center section 10 which is preferably made of silicon carbide; however, other materials, such as, silicon nitride, platinum, gold, zirconia, etc., can be employed. Attached to the emitter section 10 are end sections 12 and 14 which are also preferably made of silicon carbide, however, having a lower resistivity in order to reduce the temperature during operation of these end sections to facilitate electrical contact therewith as well as to reduce wasted heat loss. The end sections 12 and 14 are also of greater cross-sectional area than the center section to further reduce the resistance of the elements and thereby the temperature at which these elements heat up during operation.

The emitter is disposed within a protective tube 16 which is preferably made of quartz or sapphire. The protective tube is particularly useful in environments where there is wind movement which would reduce the temperature of the emitter by convection losses. The extreme ends 18 of the end sections 12 and 14 are preferably coated with a metal in order to provide a good electrical contact. In one reduction to practice of the invention the sections 18 were flame-sprayed with aluminum.

The emitter and the protective tube are retained within end caps 20 to which electrical connections from an electrical power source would be made. Preferably at least a portion of the end sections 12 and 14 have flats 22 thereon for permitting retention of the emitter within the end caps by set screws 24. The end caps have shoulders 26 therein. A plurality of washers 28, 30, 32, and 34 are disposed in the end caps 20 against the shoulders 26. Washers 30 and 34 are flat washers while washers 28 and 32 are wave washers. The protective tube 16 is disposed within the end caps against the washers. Since the emitter and protective tube are made of different materials, the deflectable wave washers allow for the different rate of expansion and contraction of the emitter and protective tube during heating and cooling thereof. Other spring mechanisms such as a coil spring may be used instead of the washers.

The inner sections 36 of the end caps are split in order to grip the protective tube. Preferably the end caps have spherical ends 38 in order that no bending moment will be imposed on the emitter since the emitter elements are relatively brittle and cannot withstand much bending. In order to apply power to the resistive heater sockets would be provided to accommodate the end caps 20.

Figure 2:
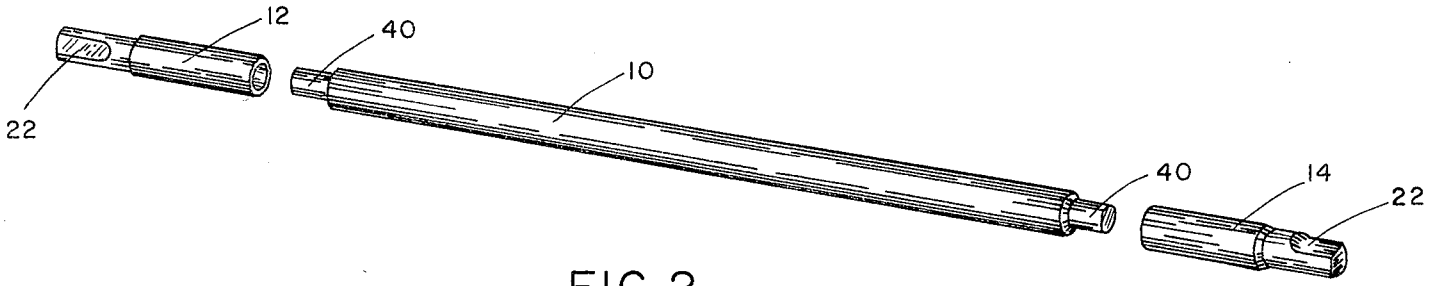
FIG. 2 is an exploded view of the emitter of the resistive heater of FIG. 1.

The manner in which the emitter including center sections 10 and end sections 12 and 14 is preferably made is shown in greater detail in FIG. 2. The center section 10 of the emitter is reduced at the ends 40 thereof and the end sections 12 and 14 which are of greater diameter are drilled so as to accommodate the smaller sections 40 of the emitter 10. These smaller sections 40 are put into the drilled portions of the end sections 12 and 14 and preferably bonded together using a silicon carbide cement.

While we have described above the principles of our invention in connection with specific apparatus, it is to be clearly understood that this description is made only by way of example and not as a limitation of the scope of our invention as set forth in the accompanying claims.

We claim:

1. A resistive heater, comprising:

an emitter for radiating infrared energy;

a protective tube surrounding said emitter which will pass such infrared energy; and electrical contact means accommodating said emitter and said protective tube, including means for compensating for the difference in expansion and contraction of said emitter and said protective tube during heating and cooling, said electrical contact means including an electrical contact having an internal shoulder, means for rigidly attaching said emitter to said electrical contact, and means for flexibly coupling said protective tube to said electrical contact with no fixed connection between said protective tube and said electrical contact, said flexible coupling means including at least one deflectable member arranged intermediate said internal shoulder and said protective tube.

2. A resistive heater as defined in claim 1 wherein said flexible coupling means includes a plurality of washers at least one of which is deflectable.

3. A resistive heater as defined in claim 2 wherein said deflectable washer is a wave washer.

* * * * *